US008957932B2

(12) United States Patent
Koga

(10) Patent No.: US 8,957,932 B2
(45) Date of Patent: Feb. 17, 2015

(54) EXPOSURE APPARATUS AND IMAGE FORMING APPARATUS

(75) Inventor: Katsuhide Koga, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/572,246

(22) Filed: Aug. 10, 2012

(65) Prior Publication Data

US 2013/0215211 A1 Aug. 22, 2013

(30) Foreign Application Priority Data

Sep. 1, 2011 (JP) ..... 2011-191068

(51) Int. Cl.

| | |
|---|---|
| ***B41J 2/435*** | (2006.01) |
| ***B41J 2/385*** | (2006.01) |
| ***B41J 2/47*** | (2006.01) |
| ***G03G 15/043*** | (2006.01) |
| ***G03G 15/04*** | (2006.01) |

(52) U.S. Cl.

CPC ..... *G03G 15/043* (2013.01); *G03G 15/04072* (2013.01)

USPC ..... 347/237; 347/130; 347/132; 347/247

(58) Field of Classification Search

CPC ..... B41J 2/473; B41J 2/442; B41J 2/455; B41J 2/385; B41J 2/435; B41J 2/47

USPC ..... 347/130, 132, 237, 247

See application file for complete search history.

(56) References Cited

U.S. PATENT DOCUMENTS

| | | | | |
|---|---|---|---|---|
| 6,266,078 | B1 | 7/2001 | Koga et al. | 347/236 |
| 6,396,858 | B2 | 5/2002 | Kawakami et al. | 372/38.02 |
| 6,919,979 | B2 | 7/2005 | Seki et al. | 359/204 |
| 7,268,797 | B2 | 9/2007 | Hata et al. | 347/237 |
| 7,746,370 | B2 | 6/2010 | Hata et al. | 347/237 |
| 8,120,633 | B2 | 2/2012 | Koga | 347/236 |
| 2008/0266375 | A1* | 10/2008 | Seki | 347/237 |
| 2009/0190617 | A1* | 7/2009 | Kikuchi | 372/29.021 |
| 2010/0290491 | A1* | 11/2010 | Kyogoku | 372/38.01 |
| 2011/0221847 | A1* | 9/2011 | Takezawa | 347/118 |

FOREIGN PATENT DOCUMENTS

| | | |
|---|---|---|
| JP | 2008-275901 | 11/2008 |

* cited by examiner

*Primary Examiner* — Justin Seo
*Assistant Examiner* — Kendrick Liu
(74) *Attorney, Agent, or Firm* — Fitzpatrick, Cella, Harper & Scinto

(57) ABSTRACT

An exposure apparatus according to this invention uses, as a correction value, the difference between a threshold current obtained from the light emitting characteristics of a single laser light source when only the single laser light source emits a laser beam, and a threshold current obtained from the light emitting characteristics of the single laser light source when the single laser light source emits a laser beam while the bias currents are supplied to the remaining laser light sources other than the single laser light source. The exposure apparatus uses the correction value to correct bias currents and switching currents determined by APC, and exposes the surface of an image carrier with laser beams output from the plurality of laser light sources based on the corrected bias currents and switching currents.

3 Claims, 13 Drawing Sheets

EXPOSURE APPARATUS AND IMAGE FORMING APPARATUS

BACKGROUND OF THE INVENTION

1. Field of the Invention

The present invention relates to an exposure apparatus, and an image forming apparatus which uses the exposure apparatus.

2. Description of the Related Art

An electrophotographic image forming apparatus generally exposes and scans the surface of an image carrier such as a photosensitive member with a laser beam emitted by a laser light source, thereby forming, on the surface of the image carrier, an electrostatic latent image based on image information. As a known exposure scheme, an image forming apparatus uses, for example, the background exposure (BAE) scheme of exposing based on image information a portion (non-image-forming area) in which no image is to be formed, and not exposing a portion (image-forming area) in which an image is to be formed, on the surface of a charged photosensitive member.

In the BAE image forming apparatus, to maintain a given image quality without generating a density variation in an image obtained by developing an electrostatic latent image on a photosensitive member using a developer (for example, toner), it is necessary to uniform the surface potential (dark and light potentials) of the electrostatic latent image. A technique for uniforming the surface potential of the photosensitive member has been proposed in Japanese Patent Laid-Open No. 2008-275901. In the technique proposed in Japanese Patent Laid-Open No. 2008-275901, a bias current and switching current supplied to a light source are controlled in accordance with a correction value for the sensitivity of the surface of the photosensitive member, thereby controlling the light power of a laser beam emitted by the light source. In light power control described in Japanese Patent Laid-Open No. 2008-275901, a driving current for emitting a laser beam at each of a predetermined target light power and its one fourth is determined by APC (Automatic Power Control) to calculate a light emission start current (threshold current) value based on the determined driving current. Also, the bias current is controlled by adding a current value corresponding to the sensitivity correction value to the calculated light emission start current value.

In the technique described in Japanese Patent Laid-Open No. 2008-275901, laser beam light power control can be performed so as to cancel a potential variation on the surface of the photosensitive member, as long as a laser light emission start current can be calculated precisely. However, if a multibeam laser is used as a light source for exposing and scanning a photosensitive member, it may be impossible to sufficiently reduce a potential variation on the surface of the photosensitive member, as will be described hereinafter.

Note that FIG. 6A is a graph illustrating an example of laser light emitting characteristics representing the relationship between a driving current I of a single laser placed in a laser chip as a light source when the single laser emits a laser beam, and a light power L detected by a photodiode PD placed in the laser chip. The laser slightly emits light without laser oscillation in a region in which the driving current I is zero to a threshold current Ith (exclusive), while it emits and outputs a laser beam with laser oscillation in a region in which the driving current I is equal to or higher than the threshold current Ith, as shown in FIG. 6A. The threshold current Ith can be calculated as the laser light emitting region exhibits linear characteristics, as shown in FIG. 6A, from driving currents IH and IL obtained by APC upon setting a light power Po and its one fourth, respectively, as target light powers.

On the other hand, when APC is performed for a multibeam laser obtained by arranging a plurality of lasers in a laser chip as light sources, it is necessary to perform APC for each of the plurality of lasers. FIG. 6B is a graph illustrating an example (605) of light emitting characteristics obtained by performing APC for one of a plurality of lasers arranged within a laser chip in a multibeam laser. Note that a line 601 shows an example of the actual light emitting characteristics of a laser to undergo APC, and lines 602 to 604 show examples of the light emitting characteristics of three lasers other than the laser to undergo APC when these three lasers emit laser beams without laser oscillation.

When APC can be appropriately performed for the target laser in the multibeam laser, the light emitting characteristics indicated by the line 601 can be obtained. However, it is a common practice in a multibeam laser to, while APC is executed for one of a plurality of lasers, supply bias currents lower than a threshold current to the remaining lasers. The bias currents are supplied to improve the laser light emission response characteristics. In this case, the lasers other than the laser to undergo APC are slightly emitting laser beams (in a bias light emission state) due to the bias currents supplied to them, although they are not in a state of laser oscillation. In such a state, when APC is performed for one target laser upon setting, for example, one fourth of the light power Po as a target light power, the photodiode PD detects the sum of the light power of the target laser and those of the remaining lasers. Hence, a driving current obtained based on the detection result obtained by the photodiode PD may change from the original driving current IL to a driving current IL', as shown in FIG. 6B. As a result, a threshold current Ith' (<Ith) lower than the original threshold current Ith by Δ is calculated, that is, an error occurs in the calculated threshold current.

As in this case, if an error occurs in the calculated threshold current, it may be impossible to sufficiently reduce a potential variation on the photosensitive member even when the driving current is corrected using the technique described in Japanese Patent Laid-Open No. 2008-275901 so as to cancel the potential variation. Note that FIG. 6C illustrates an example of how to correct the driving current based on the sensitivity correction value of the photosensitive member. Referring to FIG. 6C, a hatched region 611 shows the amount of driving current to be corrected so as to cancel a potential variation on the photosensitive member. In this case, as shown in FIG. 6C, if a threshold current Ith' lower than the original value Ith by Δ is calculated, the driving current can be corrected only in an amount indicated by a hatched region 612, so a potential variation corresponding to the amount of driving current, which is indicated by a region 613, remains on the photosensitive member. Therefore, if an error occurs in a threshold current obtained by APC for a multibeam laser, it is difficult to sufficiently reduce a potential variation on a photosensitive member in forming an image by exposure of the photosensitive member.

SUMMARY OF THE INVENTION

The present invention has been made in consideration of the above-mentioned problem, and provides a technique of appropriately correcting an error of a threshold current obtained by APC for a multibeam laser, and then driving the laser based on the correction result. The present invention also provides a technique which can reduce a potential variation on the surface of an image carrier by appropriately correcting an error of a bias current (or a threshold current) supplied to a laser, when the surface of the image carrier is scanned with a laser beam to form an electrostatic latent image.

According to one aspect of the present invention, there is provided an exposure apparatus which includes a plurality of laser light sources, and exposes a surface of an image carrier with a plurality of laser beams output from the plurality of laser light sources in accordance with driving currents, the exposure apparatus comprising: a detection unit configured to detect light powers of the plurality of laser beams output from the plurality of laser light sources; a determination unit configured to perform light power control to control the light powers detected by the detection unit to a target light power by controlling a driving current supplied to a single laser light source among the plurality of laser light sources, while bias currents are supplied to the remaining laser light sources other than the single laser light source, calculate a threshold current corresponding to a threshold at which the single laser light source starts laser oscillation upon increasing the current supplied to the single laser light source, and determine from the calculated threshold current a bias current to be supplied to the single laser light source; a correction unit configured to correct the bias current determined by the determination unit, using a predetermined correction value corresponding to a difference between a first threshold current value obtained from light emitting characteristics of the single laser light source when only the single laser light source emits a laser beam, and a second threshold current value obtained from light emitting characteristics of the single laser light source when the single laser light source emits a laser beam while the bias currents are supplied to the remaining laser light sources; and a current supply unit configured to supply, to the single laser light source, a driving current corresponding to the bias current corrected by the correction unit and a switching current corresponding to a difference between the bias current and the driving current corresponding to the target light power.

According to another aspect of the present invention, there is provided an exposure apparatus which includes a plurality of laser light sources including a first laser light source and a second laser light source, and exposes a surface of an image carrier with a plurality of laser beams output from the plurality of laser light sources in accordance with driving currents, the exposure apparatus comprising: a detection unit configured to detect light powers of the plurality of laser beams output from the plurality of laser light sources; a determination unit configured to perform light power control to control the light powers detected by the detection unit to a target light power by controlling a driving current supplied to the first laser light source, while a bias current is supplied to the second laser light source, calculate a threshold current corresponding to a threshold at which the first laser light source starts laser oscillation upon increasing the current supplied to the first laser light source, and determine from the calculated threshold current a bias current to be supplied to the first laser light source; a correction unit configured to correct the bias current determined by the determination unit, using a predetermined correction value corresponding to a difference between a first threshold current value obtained from light emitting characteristics of the first laser light source when only the first laser light source emits a laser beam, and a second threshold current value obtained from light emitting characteristics of the first laser light source when the first laser light source emits a laser beam while the bias current is supplied to the second laser light source; and a current supply unit configured to supply, to the first laser light source, a driving current corresponding to the bias current corrected by the correction unit and a switching current corresponding to a difference between the bias current and the driving current corresponding to the target light power.

According to still another aspect of the present invention, there is provided an image forming apparatus comprising: an image carrier; a charging unit configured to charge a surface of the image carrier; an exposure apparatus which includes a plurality of laser light sources, and supplies to the plurality of laser light sources a switching current switched in accordance with image information, thereby exposing a surface of the image carrier with a plurality of laser beams according to the image information; and a developing unit configured to develop an electrostatic latent image formed on the surface of the image carrier by exposure with the plurality of laser beams by the exposure apparatus, thereby forming, on the surface of the image carrier, an image to be transferred onto a recording material, wherein the exposure apparatus comprises: a detection unit configured to detect light powers of the plurality of laser beams output from the plurality of laser light sources; a determination unit configured to perform light power control to control the light powers detected by the detection unit to a target light power by controlling a driving current supplied to a single laser light source among the plurality of laser light sources, while bias currents are supplied to the remaining laser light sources other than the single laser light source, calculate a threshold current corresponding to a threshold at which the single laser light source starts laser oscillation upon increasing the current supplied to the single laser light source, and determine from the calculated threshold current a bias current to be supplied to the single laser light source; a correction unit configured to correct the bias current determined by the determination unit, using a predetermined correction value corresponding to a difference between a first threshold current value obtained from light emitting characteristics of the single laser light source when only the single laser light source emits a laser beam, and a second threshold current value obtained from light emitting characteristics of the single laser light source when the single laser light source emits a laser beam while the bias currents are supplied to the remaining laser light sources; and a current supply unit configured to supply, to the single laser light source, a driving current corresponding to the bias current corrected by the correction unit and a switching current corresponding to a difference between the bias current and the driving current corresponding to the target light power.

According to yet another aspect of the present invention, there is provided an exposure apparatus which includes a plurality of laser light sources, and exposes a surface of an image carrier with a plurality of laser beams output from the plurality of laser light sources in accordance with driving currents, the exposure apparatus comprising: a detection unit configured to detect light powers of the plurality of laser beams output from the plurality of laser light sources; a determination unit configured to cause a driving current to be supplied to a single laser light source among the plurality of laser light sources while threshold currents are supplied to the plurality of laser light sources, and determine a value of a threshold current corresponding to the single laser light source, based on a light power of a laser beam emitted by the single laser light source, which is detected by the detection unit, the determination unit determining threshold currents corresponding to the plurality of laser light sources, respectively, and determining bias currents corresponding to the plurality of laser light sources, respectively, based on the determined threshold currents; a driving current source configured to supply the bias currents determined by the determination unit to the plurality of laser light sources, and supply switching currents to the plurality of laser light sources based on image data; and a driving current source configured to supply correction currents to the plurality of laser light sources, respectively.

According to still yet another aspect of the present invention, there is provided an exposure apparatus which includes a plurality of laser light sources, and exposes a surface of an image carrier with a plurality of laser beams output from the plurality of laser light sources in accordance with driving currents, the exposure apparatus comprising: a detection unit configured to detect light powers of the plurality of laser beams output from the plurality of laser light sources; a determination unit configured to cause a driving current to be supplied to a single laser light source among the plurality of laser light sources while threshold currents are supplied to the plurality of laser light sources, and determine a value of a threshold current corresponding to the single laser light source, based on a light power of a laser beam emitted by the single laser light source, which is detected by the detection unit, the determination unit determining threshold currents corresponding to the plurality of laser light sources, respectively, and determining bias currents corresponding to the plurality of laser light sources, respectively, based on the determined threshold currents; and a driving current source, which includes a correction unit configured to correct the bias currents determined by the determination unit, configured to supply the bias currents corrected by the correction unit to the plurality of laser light sources, and supply switching currents to the plurality of laser light sources based on image data.

Further features of the present invention will become apparent from the following description of exemplary embodiments with reference to the attached drawings.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

First Embodiment

Configuration of Image Forming Apparatus 100

Figure 1:
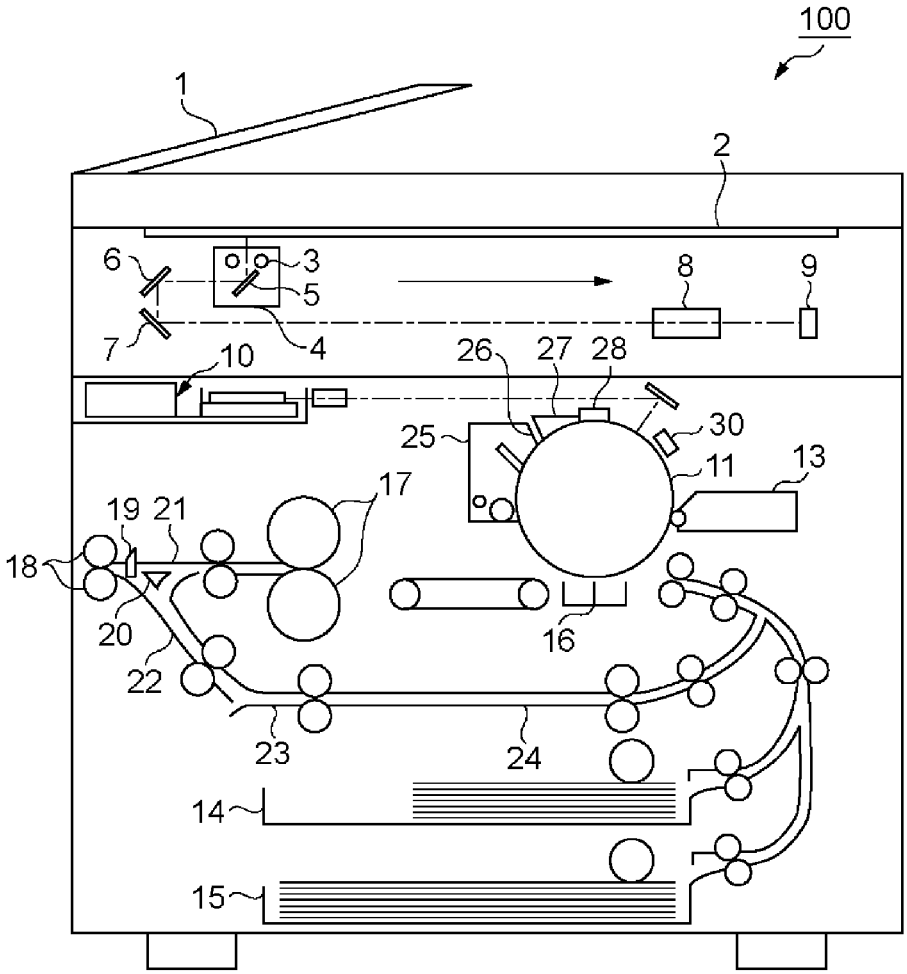
FIG. 1 is a schematic sectional view of an image forming apparatus 100 according to the first embodiment.

The basic operations of an exposure apparatus and image forming apparatus according to the first embodiment of the present invention will be described first with reference to FIG. 1. FIG. 1 is a schematic sectional view of an image forming apparatus 100 according to this embodiment.

In the image forming apparatus 100, documents stacked in a document feeder 1 are sequentially conveyed onto the surface of a document glass platen 2 one by one. When each document is conveyed onto the surface of the document glass platen 2, a lamp unit 3 of a reading unit 4 is turned on, and the reading unit 4 irradiates the document with light while moving in a direction indicated by an arrow 110. The light reflected by the document passes through a lens 8 via mirrors 5, 6, and 7, is input to an image sensor unit 9, and is converted into an image signal. The image signal output from the image sensor unit 9 is temporarily stored in an image memory (not shown). The image signal is then read from the image memory and input to an exposure controller 10.

The exposure controller 10 irradiates the surface of a photosensitive member 11 with a laser beam in accordance with the input image signal (image information) to scan the surface of the photosensitive member 11 with the laser beam, thereby exposing the surface of the photosensitive member 11 with the laser beam. This forms an electrostatic latent image on the surface of the photosensitive member 11. Note that the photosensitive member 11 is an example of an image carrier. Also, a potential sensor 30 detects the surface potential of the photosensitive member 11, and monitors whether this surface potential has a desired value. The electrostatic latent image formed on the surface of the photosensitive member 11 is developed by a developer 13, thereby forming, on the surface of the photosensitive member 11, an image (toner image) to be transferred onto a recording material. The toner image formed on the surface of the photosensitive member 11 moves to a transfer unit 16 upon rotation of the photosensitive member 11, and is transferred onto the surface of the recording material by the transfer unit 16.

A recording material onto which a toner image is to be transferred by the transfer unit 16 is fed and conveyed from a recording material stacker 14 or 15 in accordance with the timing at which the toner image reaches the transfer unit 16. A recording material onto which a toner image is transferred by the transfer unit 16 is conveyed to a fixing unit 17. The fixing unit 17 fixes the toner image on the surface of the recording material. After the fixing process by the fixing unit 17, the recording material is discharged outside the image forming apparatus 100 from a discharge unit 18.

After the transfer process by the transfer unit 16, a cleaner 25 removes the toner remaining on the surface of the photosensitive member 11, thereby cleaning the surface of the photosensitive member 11. An auxiliary charger 26 then eliminates the charge on the surface of the photosensitive member 11 such that the photosensitive member 11 can obtain good charge characteristics upon charging by a primary charger 28 in the next image forming operation. Also, after a pre-exposure lamp 27 eliminates the residual charge on the surface of the photosensitive member 11, the primary charger 28 charges the surface of the photosensitive member 11. The image forming apparatus 100 repeats the above-mentioned series of processes to form images on a plurality of recording materials.

Configuration of Exposure Controller 10

Figure 2A:
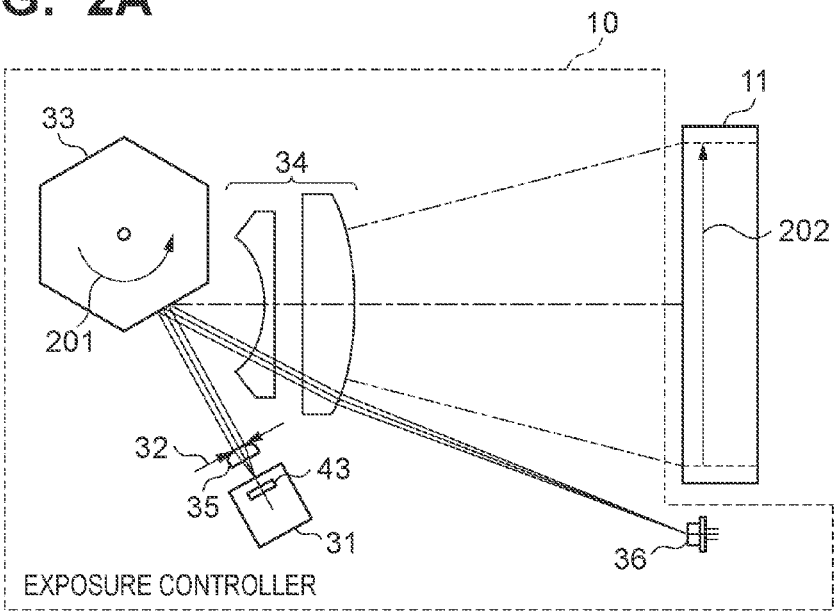
FIG. 2A is a view showing the configuration of an exposure controller 10 according to the first embodiment.
Figure 2B:
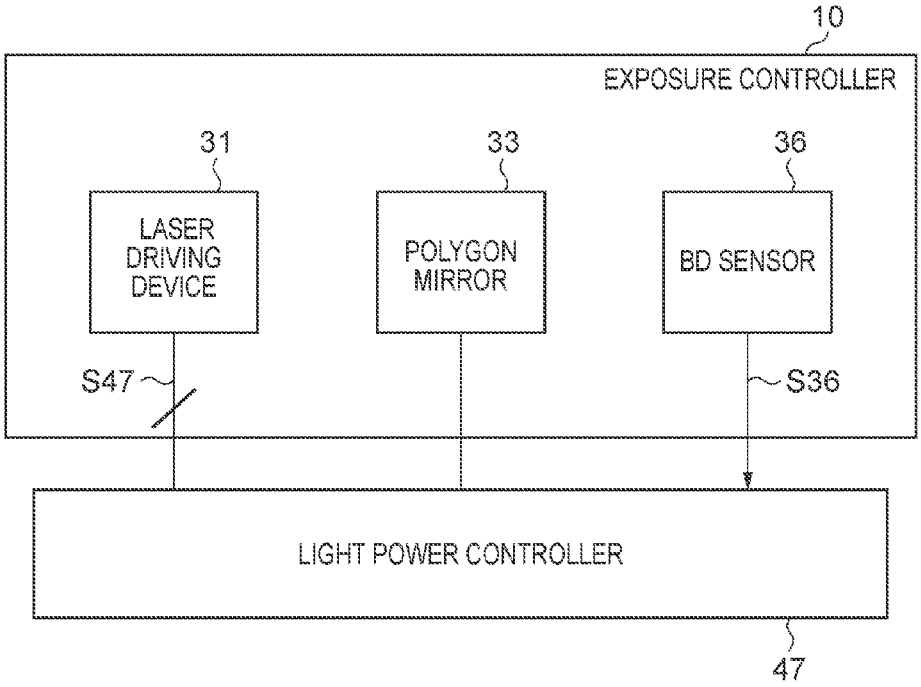
FIG. 2B is a block diagram showing the connection relationship between the exposure controller 10 and a light power controller 47 according to the first embodiment.

The exposure controller 10 and a light power controller 47 which controls the exposure controller 10 according to this embodiment will be described with reference to FIGS. 2A and 2B. Note that in this embodiment, the exposure controller 10 and light power controller 47 serve as an example of an exposure apparatus which includes a plurality of laser light sources, and exposes the surface of an image carrier with a plurality of laser beams output from the plurality of laser light sources in accordance with driving currents. The exposure controller 10 includes a laser driving device 31, collimator lens 35, stop 32, polygon mirror 33, f-θ lens 34, and BD (Beam Detect) sensor 36, as shown in FIG. 2A. The laser driving device 31 includes a plurality of semiconductor lasers (laser diodes (LD)) corresponding to a plurality of laser light sources (light emitting elements), and one photodiode (PD). Also, the light power controller 47 includes a CPU, which controls the exposure controller 10.

The operation of the exposure controller 10 based on the control of the light power controller 47 will be described. When the image forming apparatus 100 starts its image formation, the light power controller 47 outputs a control signal S47 to the laser driving device 31. The light power controller 47 controls the laser driving device 31 using the control signal S47 so that a plurality of lasers LD (a plurality of laser light sources) in a laser chip 43 emit light beams (laser beams) at a desired light power in accordance with a light emission sequence (to be described later). Each laser beam emitted by the laser chip 43 is converted into nearly collimated light upon passing through the collimator lens 35 and stop 32, and strikes the polygon mirror 33 at a predetermined diameter.

The polygon mirror 33 rotates at a constant angular velocity in a direction indicated by an arrow 201, and reflects each incident laser beam at a continuous angle upon the rotation process. Upon this operation, the polygon mirror 33 deflects each incident laser beam. Each laser beam deflected by the polygon mirror 33 enters the f-θ lens 34. The f-θ lens 34 focuses a plurality of incident laser beams, and corrects distortion aberrations so as to guarantee temporal linearity in scanning the surface of the photosensitive member 11 with the plurality of laser beams. This combines the plurality of laser beams with each other on the surface of the photosensitive member 11 to scan this surface at an equal velocity in a direction indicated by an arrow 202.

Note that the BD sensor 36 serves to detect light reflected by the polygon mirror 33. The BD sensor 36 is placed at a position at which it detects a laser beam on the scanning start side among laser beams reflected by the respective specular surfaces of the polygon mirror 33. The BD sensor 36 outputs a detect signal (BD signal) S36 to the light power controller 47 upon detecting the laser beam. The light power controller 47 uses the input BD signal S36 as a synchronization signal for a synchronization process between the rotation of the polygon mirror 33 and the timing at which the laser driving device 31 starts to write an image signal.

The light power controller 47 monitors a laser beam detection period indicated by the BD signal S36. Also, the light power controller 47 controls to accelerate or decelerate a polygon motor driver (not shown) which drives the polygon mirror 33, so that the period in which the polygon mirror 33 rotates through 360° always stays constant. Upon this control operation, the light power controller 47 sets the polygon mirror 33 in a stable rotating state.

Configuration of Laser Driving Device 31

Figure 3A:
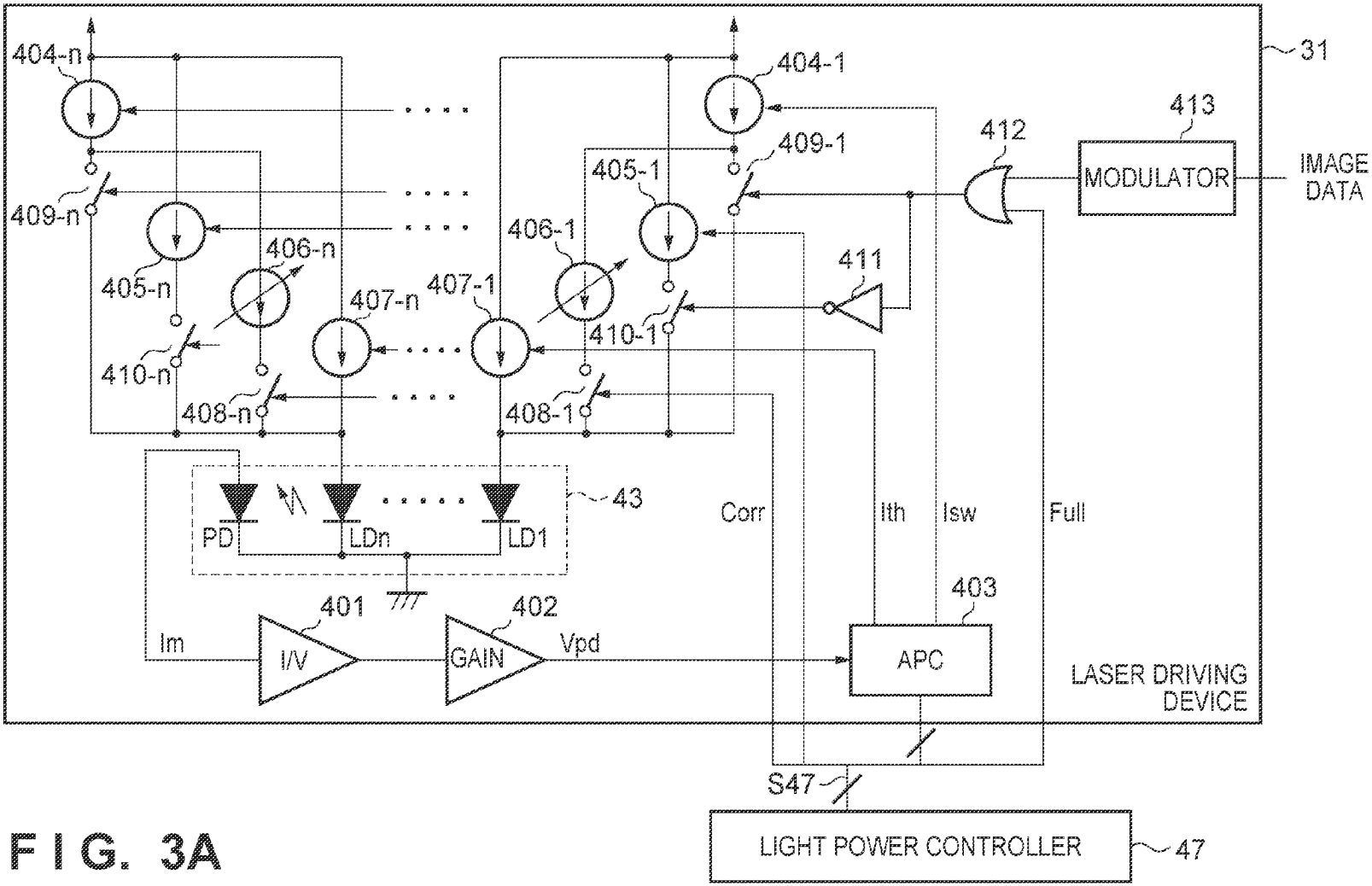
FIG. 3A is a circuit diagram showing the configuration of a laser driving device 31 according to the first embodiment.

The operation of the laser driving device 31 will be described with reference to FIGS. 3A, 3B, and 3C. The configuration of the laser driving device 31 will be described first with reference to FIG. 3A.

The laser chip 43 includes a plurality of laser diodes (LD1 to LDn) and one photodiode (PD). The photodiode PD in the laser chip 43 functions as a detection unit, and outputs a current Im corresponding to the detected light power to a current/voltage converter 401. The current/voltage converter 401 converts the input current Im into a voltage, and outputs it. An amplifier 402 serves to adjust the gain of the voltage output from the current/voltage converter 401. A voltage Vpd having a gain adjusted by the amplifier 402 is applied to an APC circuit 403.

The control signal S47 from the light power controller 47 is input to the APC circuit 403. Based on the control of the light power controller 47, the APC circuit 403 performs light power control in which the light powers of the plurality of (n) lasers LD1 to LDn are adjusted so that the lasers LD1 to LDn emit laser beams having a predetermined light power. A modulator 413 outputs to a logic element 412 an image modulation signal for modulating a driving current supplied to each of the lasers LD1 to LDn, using image data input from, for example, a memory (not shown). When, for example, PWM is performed for the driving current, the modulator 413 outputs a pulse signal having a width corresponding to the image data to the logic element 412 as an image modulation signal. The logic element 412 outputs to an inverter 411 and a switch 409-1 the logical sum of the image modulation signal output from the modulator 413 and a full-on signal Full output from the light power controller 47.

The inverter 411 inverts the logical value of the signal output from the logic element 412, and outputs the inverted value. That is, the inverter 411 outputs a low-level (Lo) signal if the input signal is a high-level (Hi) signal, or outputs a high-level (Hi) signal if the input signal is a low-level (Lo) signal. The signal output from the inverter 411 is supplied to a switch 410-1.

The laser driving device 31 includes current sources (driving current sources) 404-1 to 407-1 for supplying currents to the laser LD1 (energizing the laser LD1) in the laser chip 43, and switches 408-1 to 410-1 for switching the states of current supply from the current sources 404-1 to 407-1 to the laser LD1. The current sources 404-1 to 407-1 and switches 408-1 to 410-1 corresponding to the laser LD1 will be described below. However, current sources (driving current sources) and switches 404-2 to 410-2, . . . , 404-*n* to 410-*n* similar to those of the laser LD1 are provided to the lasers LD2 to LDn, as shown in FIG. 3A.

In the following description, a threshold current corresponds to a threshold (defined as Ith in FIG. 6A) at which each laser light source (LD1 to LDn) starts its laser oscillation upon increasing the amount of current supplied to this laser light source. Also, a switching current is a current (defined as IH–Ith in FIG. 6A) obtained by subtracting the threshold current from a current corresponding to a target light power, and corresponds to the difference between the threshold current and the current corresponding to the target light power. Moreover, the current sources 404-1 to 407-1 for supplying currents to the laser LD1 function as a current supply unit which supplies a driving current corresponding to a threshold current and switching current to the laser LD1. The same applies to the current sources which supply currents to the remaining lasers LD (LD2 to LDn), and the current sources 404-*n* to 407-*n* for supplying currents to the laser LDn, for example, function as a current supply unit which supplies a driving current corresponding to the threshold current and switching current to the laser LDn.

The bias current source 407-1 is connected between a power supply and the laser LD1. A current supplied from the bias current source 407-1 to the laser LD1 undergoes variable control by the APC circuit 403. The bias current source 407-1 serves to supply the threshold current Ith determined by the APC circuit 403 to the laser LD1, and functions as a first current source in this embodiment.

Note that a bias current Ib is normally obtained by multiplying the threshold current Ith by a predetermined coefficient $\alpha$. In this embodiment, $\alpha$=1 and Threshold Current Ith=Bias Current Ib. The following description assumes that a bias current supplied to the laser LD as a standby current is Ith (=Ib). Note that the threshold current Ith and bias current Ib may have different values.

The switching current source 404-1 is connected to the laser LD1 in parallel with the bias current source 407-1 between the power supply and the laser LD1. A current supplied from the switching current source 404-1 to the laser LD1 undergoes variable control by the APC circuit 403. The switching current source 404-1 serves to supply a switching current Isw determined by the APC circuit 403 to the laser LD1, and functions as a second current source in this embodiment.

The switch 409-1 is connected between the switching current source 404-1 and the laser LD1. The switch 409-1 is connected to the laser LD1 in parallel with the bias current source 407-1 between the laser LD1 and the switching current source 404-1, as shown in FIG. 3A. Current supply from the switching current source 404-1 to the laser LD1 is turned on/off in accordance with ON/OFF of the switch 409-1. That is, the switch 409-1 switches the state of current supply from the switching current source 404-1 to the laser LD1 between a supplied state and an unsupplied state. Upon this operation, a current output from the switching current source 404-1 is supplied to the laser LD1 as the switching current Isw switched in accordance with the image data (image information).

The potential variation correction current source 405-1 is connected between the power supply and the laser LD1. Current supply from the potential variation correction current source 405-1 to the laser LD1 is turned on/off in accordance with ON/OFF of the switch 410-1 connected between the potential variation correction current source 405-1 and the laser LD1. Also, a current supplied from the potential variation correction current source 405-1 to the laser LD1 undergoes variable control in accordance with a potential variation correction value sent from the light power controller 47.

The bias current correction current source 406-1 is connected to the switching current source 404-1 in parallel with the switch 409-1 between the switching current source 404-1 and the laser LD1. Also, the bias current correction current source 406-1 is connected to the laser LD1 via the switch 408-1. The bias current correction current source 406-1 serves to partially supply (bypass) a current from the switching current source 404-1 to the laser LD1 without the mediacy of the switch 409-1, and functions as a third current source in this embodiment. Note that of a current from the switching current source 404-1, a current component bypassed to the laser LD1 by the bias current correction current source 406-1 is a partial current corresponding to a correction value for correcting the threshold current, as will be described later.

Current supply from the switching current source 404-1 to the laser LD1 via the bias current correction current source 406-1 is turned on/off in accordance with ON/OFF of the switch 408-1 in response to an instruction from the light power controller 47.

(APC Operation)

An APC operation will be described below with reference to FIGS. 3A to 3D. Note that upon defining the laser LD1 as a first laser light source, and the lasers LD2 to LDn as second laser light sources, an APC operation for only the laser LD1 will be described for the sake of simplicity. However, APC operations can be implemented for the lasers LD1 to LDn by performing the same control operations as in the laser LD1 for the remaining lasers LD2 to LDn.

An APC operation while no current is supplied from the bias current correction current source 406-1 to the laser LD1 (the switch 408-1 is OFF) will be described first. To make the laser LD1 emit a laser beam, the light power controller 47 controls the bias current source 407-1 so that the bias current supplied from the bias current source 407-1 to the laser LD1 becomes a bias current Ith1. Also, the light power controller 47 controls the switching current source 404-1 so that the switching current supplied from the switching current source 404-1 to the laser LD1 becomes a switching current Isw1. Note that predetermined current values may be temporarily set as the bias current Ith1 and switching current Isw1, or a threshold current and switching current determined by the previous APC operation may be set as the bias current Ith1 and switching current Isw1.

Figure 3B:
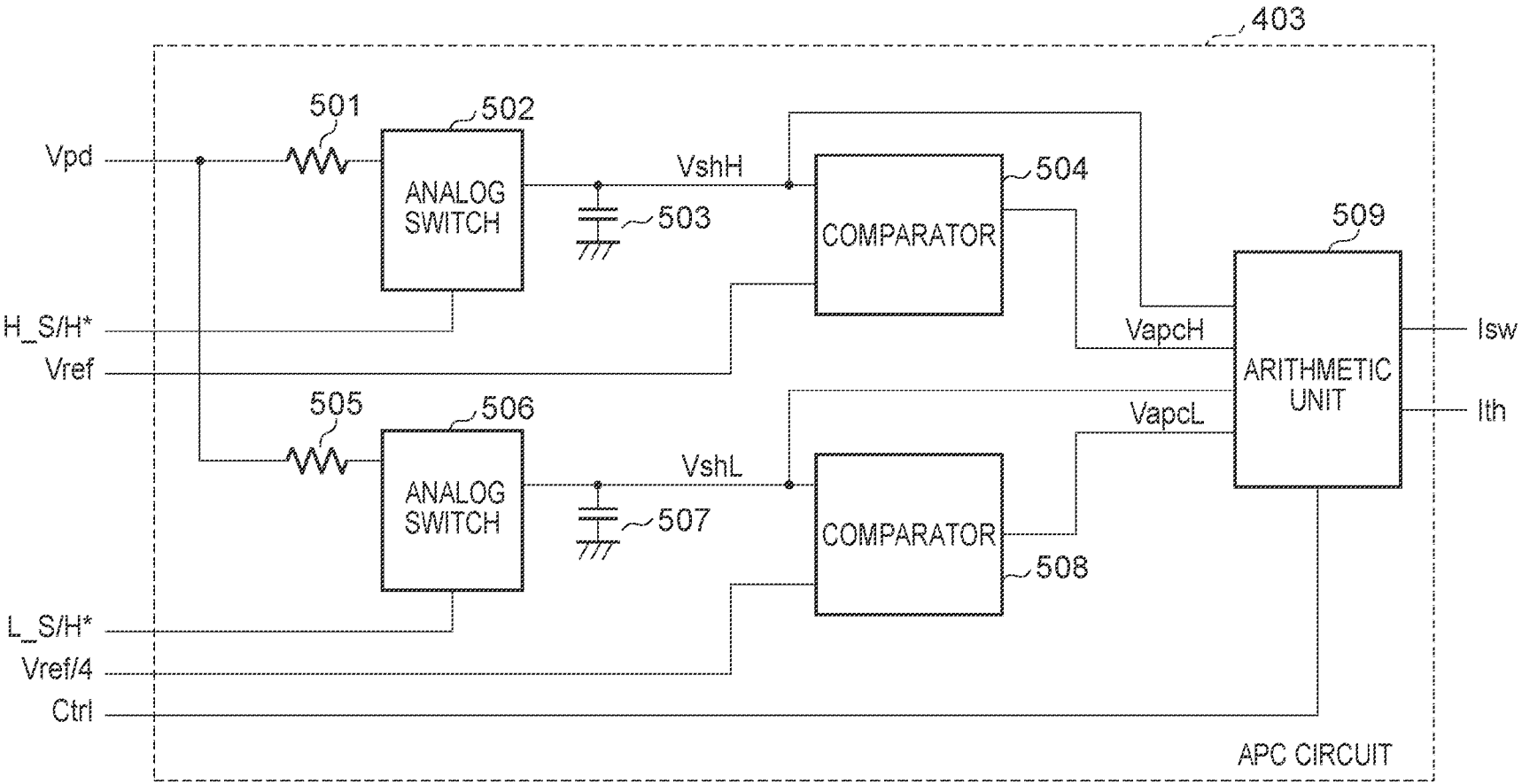
FIG. 3B is a circuit diagram showing the configuration of an APC circuit 403 according to the first embodiment.
Figure 3C:
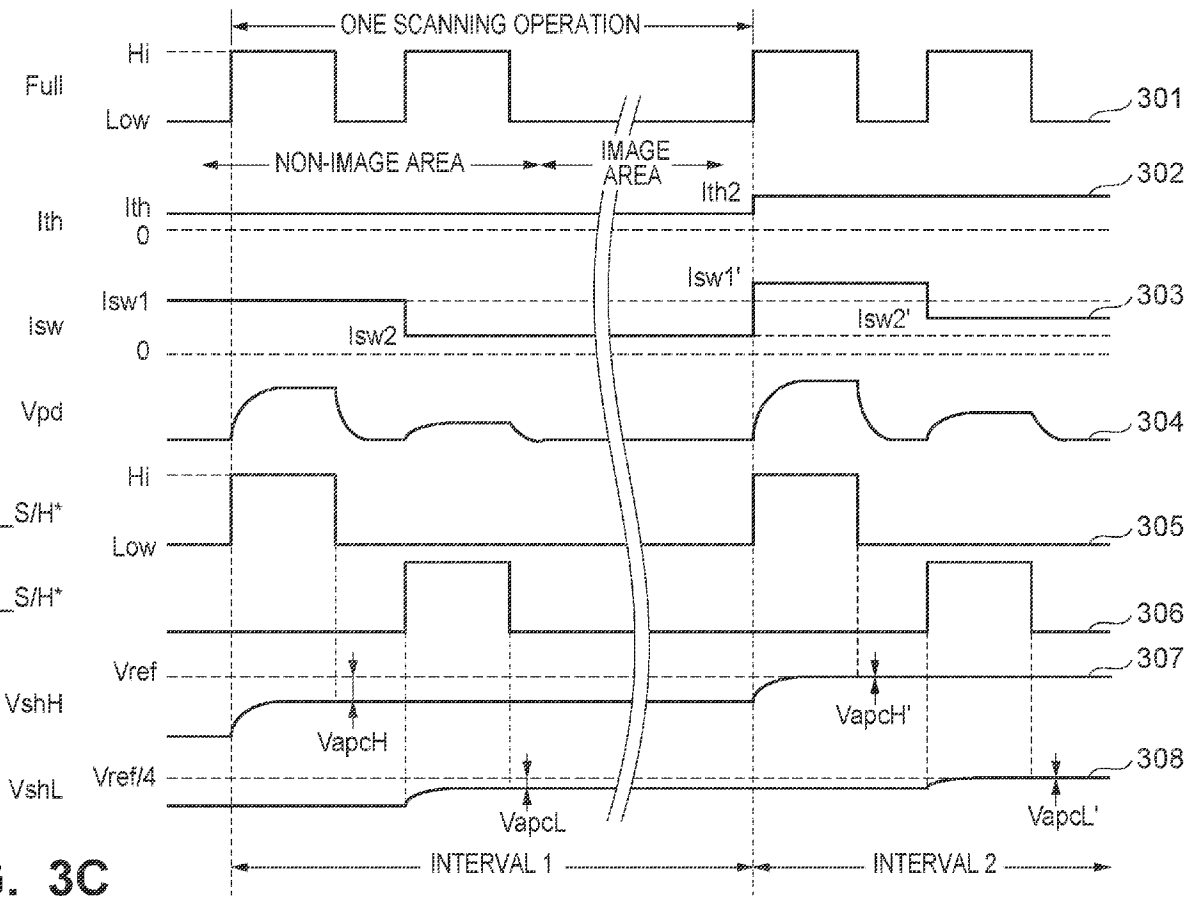
FIG. 3C is a timing chart showing a light emission sequence in the laser driving device 31 according to the first embodiment.

In interval 1 (first APC operation interval) of FIG. 3C, the light power controller 47 sets the current values of the bias current source 407-1 and switching current source 404-1 to the bias current Ith1 and switching current Isw1, respectively, and changes the full-on signal Full (waveform 301) from Lo to Hi. Upon this operation, the logic element 412 outputs Hi. As a result, the switch 409-1 is turned on, so the switching current Isw1 starts to flow from the switching current source 404-1 to the laser LD1. Also, the signal input from the logic element 412 to the inverter 411 is output to the switch 410-1 after the logical value is inverted (from Hi to Lo) by the inverter 411. This turns off the switch 410-1, so the current stops its flow from the potential variation correction current source 405-1 to the laser LD1. Hence, while the full-on signal Full is Hi, the sum current of the threshold current Ith and the switching current Isw1 flows to the laser LD1.

The photodiode PD measures the light power of a laser beam emitted by the laser LD1 upon supply of the sum current of the bias current Ith1 and the switching current Isw1, and outputs a current corresponding to this light power to the current/voltage converter 401. The current input to the current/voltage converter 401 is converted into a voltage, which is amplified by the amplifier 402. An amplified voltage Vpd is input to the APC circuit 403.

The voltage Vpd input to the APC circuit 403 is input to an analog switch 502 via a resistor 501, as shown in FIG. 3B. The analog switch 502 charges a capacitor 503 depending on a time constant, determined by the resistor 501 and capacitor 503, in accordance with a sample/hold signal H_S/H* (waveform 305) from the light power controller 47. More specifically, when the sample/hold signal H_S/H* is Hi, the analog switch 502 assumes a sample state, in which it charges the capacitor 503. However, when the sample/hold signal H_S/H* changes from Hi to Lo, the analog switch 502 assumes a hold state. Upon this operation, the capacitor 503 holds its voltage VshH (waveform 307).

The light power controller 47 changes the full-on signal Full from Hi to Lo, and changes the switching current to a switching current Isw2 (≈(¼)Isw1) without changing the bias current from the bias current Ith1. The light power controller 47 then changes the full-on signal Full from Lo to Hi, and supplies the sum current of the switching current Isw2 and the bias current Ith1 to the laser LD1, thereby making the laser LD1 emit a laser beam. Upon this operation, the light power of a laser beam emitted by the laser LD1 is measured by the photodiode PD, and a voltage Vpd corresponding to the measured light power is input to the APC circuit 403, in the same way as described above.

The voltage Vpd input to the APC circuit 403 is input to an analog switch 506 via a resistor 505. The analog switch 506 charges a capacitor 507 depending on a time constant, determined by the resistor 505 and capacitor 507, in accordance with a sample/hold signal L_S/H* (waveform 306) from the light power controller 47. More specifically, when the sample/hold signal L_S/H* is Hi, the analog switch 506 assumes a sample state, in which it charges the capacitor 507. However, when the sample/hold signal L_S/H* changes from Hi to Lo, the analog switch 506 assumes a hold state. Upon this operation, the capacitor 507 holds its voltage VshL (waveform 308). The light power controller 47 then changes the full-on signal Full from Hi to Lo.

The hold voltage VshH when the switching current Isw1 is supplied to the laser LD1 is input to a comparator 504. The comparator 504 compares the input hold voltage VshH with a reference voltage Vref corresponding to the target light power, and outputs a difference signal VapcH indicating the difference between the voltages VshH and Vref. Similarly, the hold voltage VshL when the switching current Isw2 is supplied to the laser LD1 is input to a comparator 508. The comparator 508 compares the input hold voltage VshL with one fourth (Vref/4) of the reference voltage Vref corresponding to the target light power, and outputs a difference signal VapcL indicating the difference between the voltages VshL and Vref/4.

The difference signals VapcH and VapcL output from the comparators 504 and 508, respectively, are input to an arithmetic unit 509, together with the hold voltages VshH and VshL, respectively. From the hold voltage VshH when the current supplied to the laser LD1 is (Ith1+Isw1), and the hold voltage VshL when the current supplied to the laser LD1 is (Ith1+Isw2), the arithmetic unit 509 calculates a threshold current Ith2 in accordance with:

$$Ith2=\{VshH(Ith1+Isw2)-VshL(Ith1+Isw1)\}/(VshH-VshL)$$

Also, switching currents Isw1' and Isw2' to be used in the next APC operation are calculated in accordance with:

$$Isw1'=Ith1+Isw1+IapcH-Ith2$$

$$Isw2'=Ith1+Isw2+IapcL-Ith2$$

where IapcH and IapcL are the currents corresponding to the difference signals VapcH and VapcL, respectively.

The currents Ith2, Isw1' and Isw2' calculated in the foregoing way are used in the next APC operation (an APC operation executed in interval 2 of FIG. 3C).

The APC circuit 403 executes the same process as in the above-mentioned APC operation in interval 2 of FIG. 3C as the next APC operation subsequent to the previous APC operation in interval 1. A threshold current Ith3 and switching currents Isw1" and Isw2" to be used in the next APC operation are calculated in accordance with:

$$Ith3=\{VshH'(Ith2+Isw2')-VshL'(Ith2+Isw1')\}/(VshH'-VshL')$$

$$Isw1''=Ith2+Isw1'+IapcH'-Ith3$$

$$Isw2''=Ith2+Isw2'+IapcL'-Ith3$$

where VshH' and VshL' are the hold voltages obtained by the APC operation in interval 2.

Upon repetitions of the above-mentioned APC operations, the difference signals VapcH and VapcL gradually come close to zero, so both the threshold current and switching current become stable, and the light power of the laser LD1 also becomes stable. The following description assumes that upon two APC operations as described above in intervals 1 and 2 shown in FIG. 3C, the threshold current Ith becomes stable at Ith3, and the switching current Isw becomes stable at Isw1" and Isw2". Note that of the switching currents Isw obtained by the APC operations, Isw1" is a switching current corresponding to a target light power, and Isw2" is a switching current corresponding to one fourth of the target light power. In this manner, the light power controller 47 and APC circuit 403 function as an example of a determination unit which determines a bias current and switching current to be supplied to each of a plurality of laser light sources.

Figure 6A:
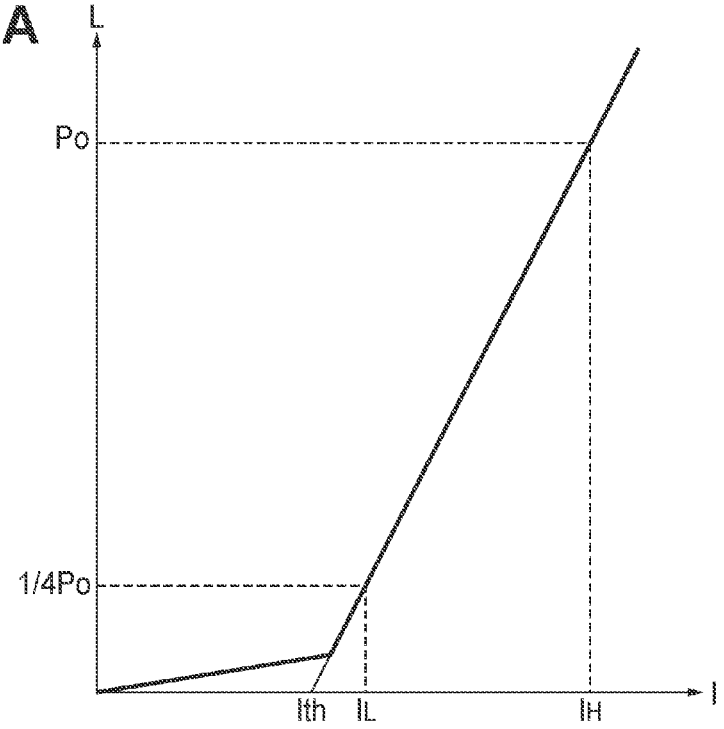
FIG. 6A is a graph showing light emitting characteristics obtained by APC when a single laser light source is used.
Figure 6B:
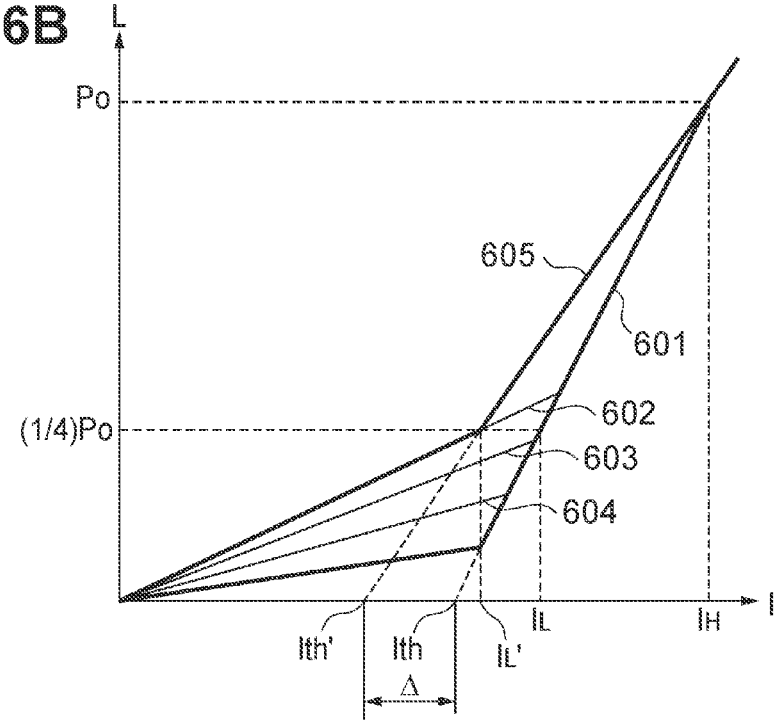
FIG. 6B is a graph showing light emitting characteristics obtained by APC when a plurality of laser light sources are used.
Figure 6C:
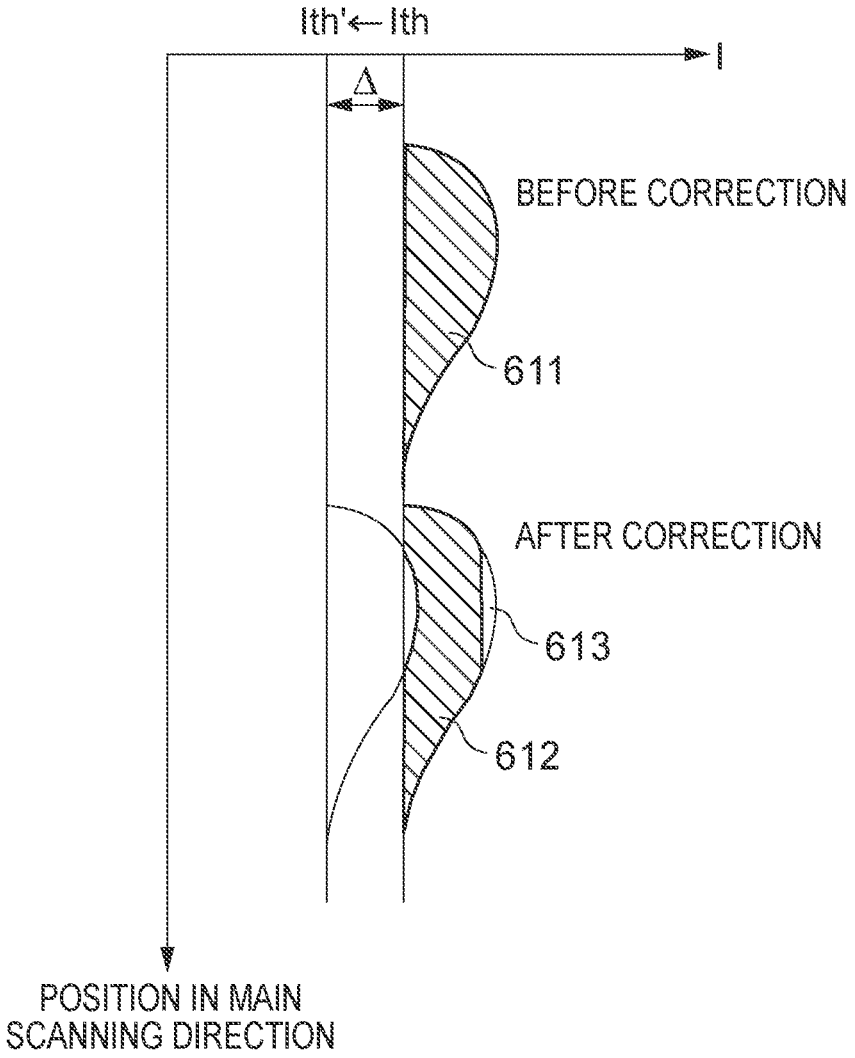
FIG. 6C is a graph showing the influence of an error which occurs in a threshold current obtained by APC when a plurality of laser light sources are used.

However, the threshold current of the light emitting characteristics of each laser obtained when an APC operation is performed for each laser in a multibeam laser chip has a value lower than that of an actual threshold current, as described with reference to FIGS. 6A to 6C. This is because during execution of APC of a single laser, the lasers other than the single laser slightly emits light (emits bias light) as well due to a bias current lower than the threshold current, so an error may occur in the light power detected using the photodiode PD, as described above.

Figure 3D:
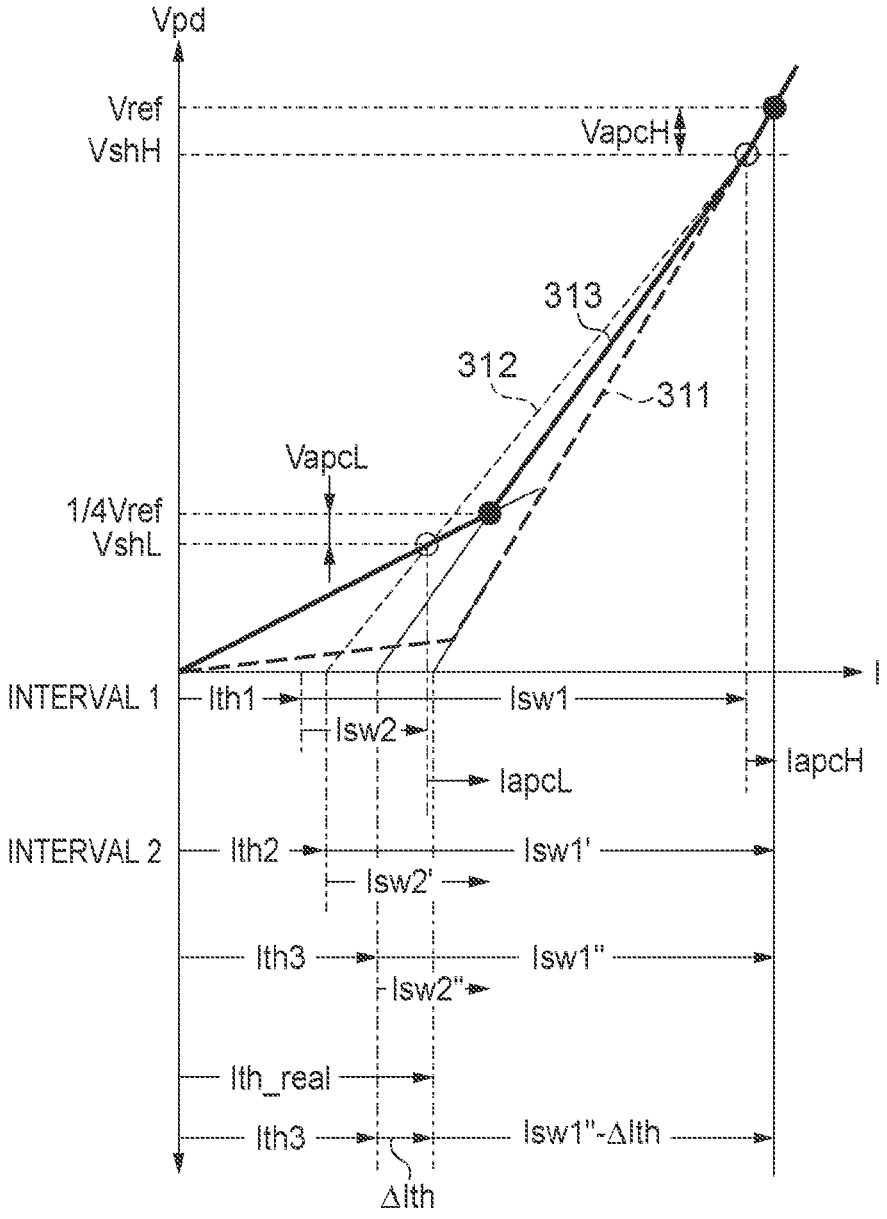
FIG. 3D is a graph showing the light emitting characteristics of a laser chip 43 placed in the laser driving device 31 according to the first embodiment.

FIG. 3D illustrates an example of light emitting characteristics 312 and 313 obtained by APC for a single laser included in a multibeam laser chip, and actual light emitting characteristics 311 for the single laser. In this case, APC is performed with reference to a reference voltage Vref corresponding to a target light power, and a voltage Vref/4 corresponding to one fourth of the target light power (to be referred to as a one-fourth light power hereinafter), as described above. The light emitting characteristics 312 shown in FIG. 3D are based on the threshold current Ith2 and switching current Isw1' obtained by the first APC operation executed in interval 1. Also, the light emitting characteristics 313 shown in FIG. 3D are based on the threshold current Ith3 and switching current Isw1" obtained by the second APC operation executed in interval 2. The threshold current Ith3 stabilized by APC has a value lower than a threshold current Ith_real of the actual light emitting characteristics 311 by ΔIth, as shown in FIG. 3D. This is because an error occurs in a current value detected by an APC operation for the one-fourth light power, as described above.

In this embodiment, to supply to each laser a current for correcting a threshold current obtained by an APC operation for this laser, the bias current correction current sources 406-1 to **406-*n* are used. Among the bias current correction current sources 406-1 to 406-*n*, the bias current correction current source 406-1 which supplies a current to the laser LD1** operates in the following way.

The bias current correction current source 406-1 uses a correction value corresponding to the difference (ΔIth) between the threshold current Ith3 influenced by the above-mentioned error and the threshold current Ith_real which is not influenced by this error, each of which is obtained by APC for the corresponding laser light source (LD1). Note that the threshold current Ith_real is obtained by APC while only the corresponding laser light source (LD1) is operated, and the laser light sources (LD2 to LDn) other than the corresponding laser light source are kept OFF. The correction value corresponds to the difference (difference value ΔIth) between the threshold current obtained from the light emitting characteristics of the corresponding laser light source (LD1) when only the corresponding laser light source emits a laser beam, and the threshold current obtained from the light emitting characteristics of the corresponding laser light source (LD1) when the corresponding laser light source emits a laser beam without laser oscillation of the remaining laser light sources (LD2 to LDn) (while bias currents are supplied to the lasers LD2 to LDn). In scanning (exposing) a photosensitive member with laser beams from the lasers LD1 to LDn to form an image, the bias current correction current source 406-1 uses the difference value ΔIth as a correction value for the threshold current to supply a current in an amount corresponding to the correction value to the laser LD1.

The difference value ΔIth can be calculated in advance as the difference value between the threshold currents Ith3 and Ith_real by measuring them during, for example, factory adjustment of the image forming apparatus 100. The threshold currents Ith3 and Ith_real correspond to first and second threshold current values, respectively, in this embodiment. In this manner, the difference value ΔIth may be prepared as a predetermined correction value and stored in, for example, a memory (not shown) in advance. Also, the bias current correction current source 406-1 may adjust, for example, a variable resistance or electronic volume included in each current source so as to supply a current having the calculated difference value ΔIth to the laser LD1. Note that when the difference value ΔIth is adjusted based on the electronic volume, a required adjustment value need only be stored in, for example, a memory (not shown) in advance.

When the light power controller 47 turns on the switch 408-1 connected to the bias current correction current source 406-1, while the bias current correction current source 406-1 is ready to supply a current having the difference value ΔIth, the bias current correction current source 406-1 supplies a correction current to the laser LD1 (energizes the laser LD1). Upon this operation, a current obtained by increasing the threshold current Ith3 from the bias current source 407-1 by an amount corresponding to the difference value ΔIth is supplied to the laser LD1 as a corrected threshold current. This means that the switch 408-1 is turned on/off, independently of the switch 409-1. Regardless of whether a switching current is supplied from the switching current source 404-1 to the laser LD1, the switch 408-1 is turned on during image formation except for at least the period in which APC is executed, so a correction current is supplied from the bias current correction current source 406-1 to the laser LD1.

Also, a switching current switched in accordance with image information is supplied from the switching current source 404-1 to the laser LD1 in accordance with ON/OFF of the switch 409-1 based on an image modulation signal (image information). When the switch 409-1 is turned on, a switching current having a value Isw1"−ΔIth is supplied from the switching current source 404-1 to the laser LD1. On the other hand, when the switch 409-1 is turned off, the supply of the switching current from the switching current source 404-1 to the laser LD1 stops.

In this manner, when the switch 409-1 is ON, a current obtained by decreasing the switching current Isw1" obtained by APC by an amount corresponding to the difference value ΔIth is supplied from the switching current source 404-1 to the laser LD1. Upon this operation, the threshold current Ith3 from the bias current source 407-1 is corrected based on a correction value (ΔIth), while the switching current Isw" from the switching current source 404-1 is corrected based on the same correction value (ΔIth). This is done to prevent a change in light power of the laser LD1 from the target light power when a switching current is supplied to the laser LD1, before and after correction of the threshold current using the difference value ΔIth. That is, the light power controller 47 turns on the switch 408-1 to operate the bias current correction current source 406-1 within the circuit, thereby correcting both the threshold current and the switching current using the correction value (ΔIth). Note that the light power controller 47 functions as a correction unit in this embodiment.

As in the laser LD1, difference values ΔIth are also calculated for the lasers LD2 to LDn, and the bias current correction current sources 406-2 to **406-*n* supply currents corresponding to the difference values ΔIth to the lasers LD2 to LDn, respectively. Also, the operations of the switching current sources 404-2 to 404-*n* and switches 409-2 to 409-*n* are the same as in the switching current source 404-1 and switch 409-1**, respectively.

In this embodiment, as the light power controller 47 and laser driving device 31 operate in the foregoing way, even if a threshold current lower than an original threshold current is obtained by APC for each laser, an image can be formed upon correction of the threshold current to the original threshold current. That is, an appropriate threshold current can be supplied to each laser even when a multibeam laser chip is adopted. Further, not only a current having a correction value (difference value) ΔIth is added to a threshold current obtained by APC, as described above, but also a switching current obtained by being subtracted by the difference value ΔIth from the threshold current is supplied from each of the switching current source 404-1 to **404-*n* to the corresponding one of the lasers LD1 to LDn. This makes it possible to maintain the sum total of the switching current and threshold current constant before and after correction of the threshold current based on the difference value ΔIth, thereby making the lasers LD1** to LDn emit laser beams without requiring to change the target light power.

Correction Operation During Image Formation

Figure 4A:
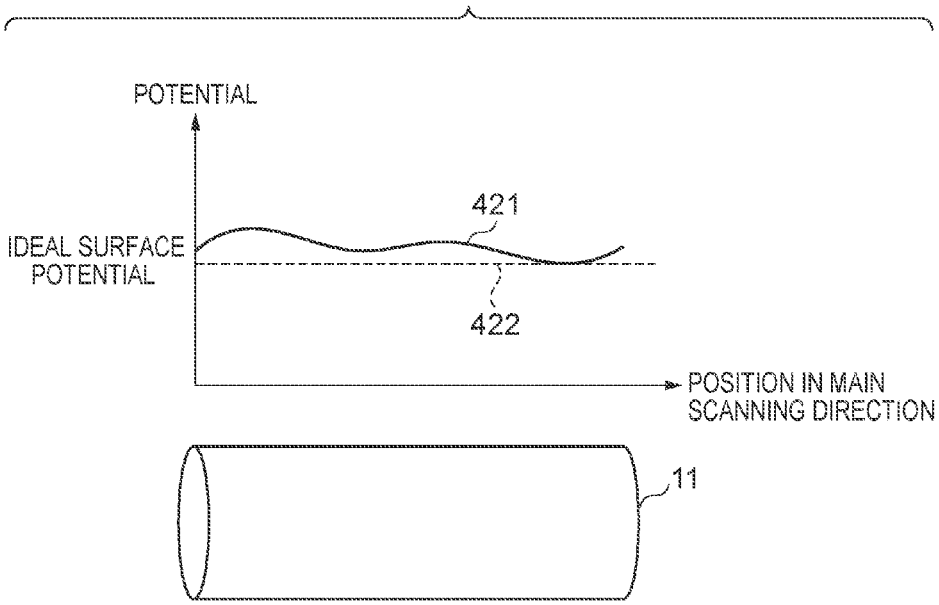
FIG. 4A is a graph showing the concept of a potential variation generated on the surface of a photosensitive member 11.
Figure 4B:
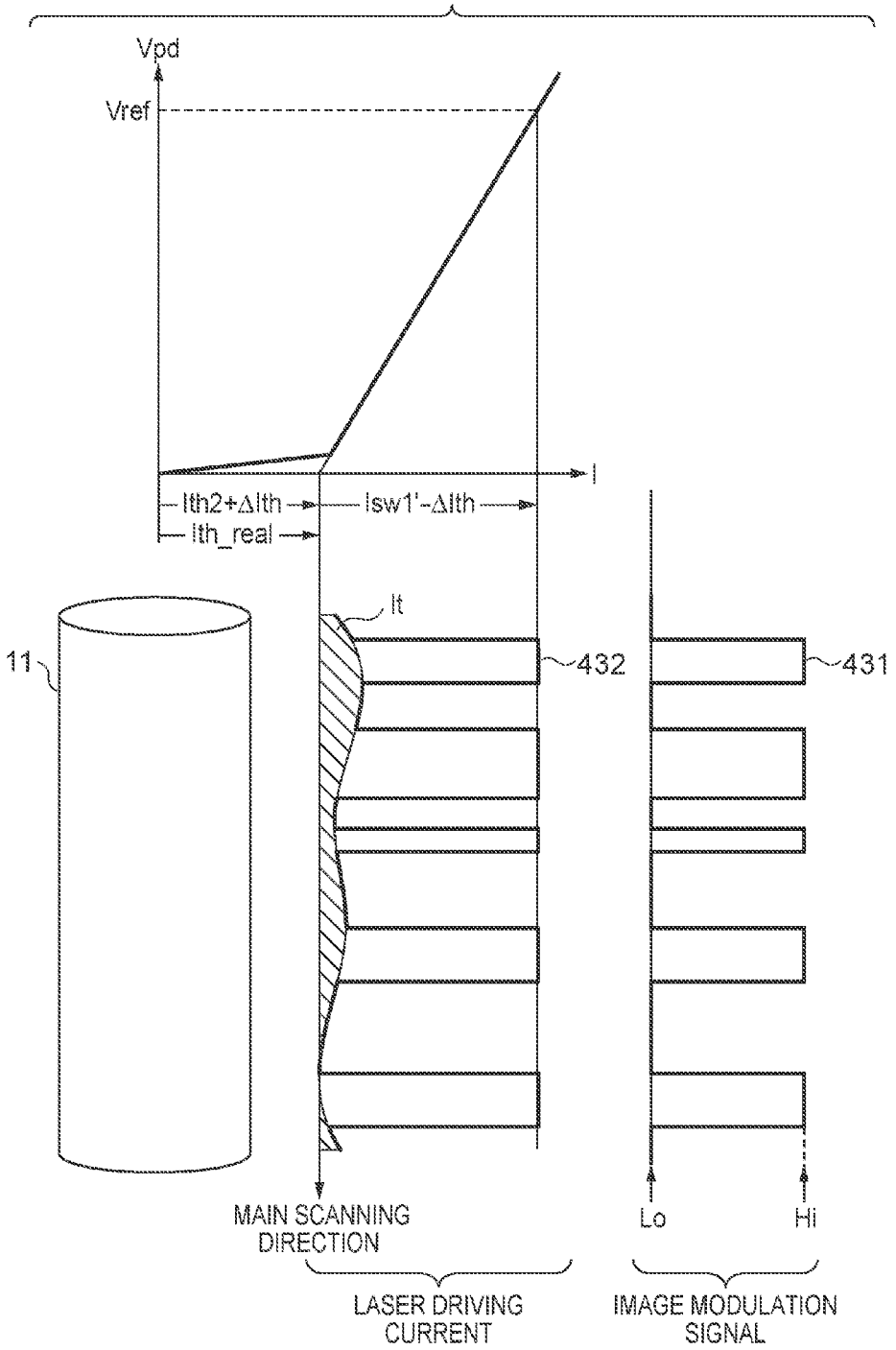
FIG. 4B is a graph showing a laser driving current in correcting the potential variation generated on the surface of the photosensitive member 11.
Figure 7:
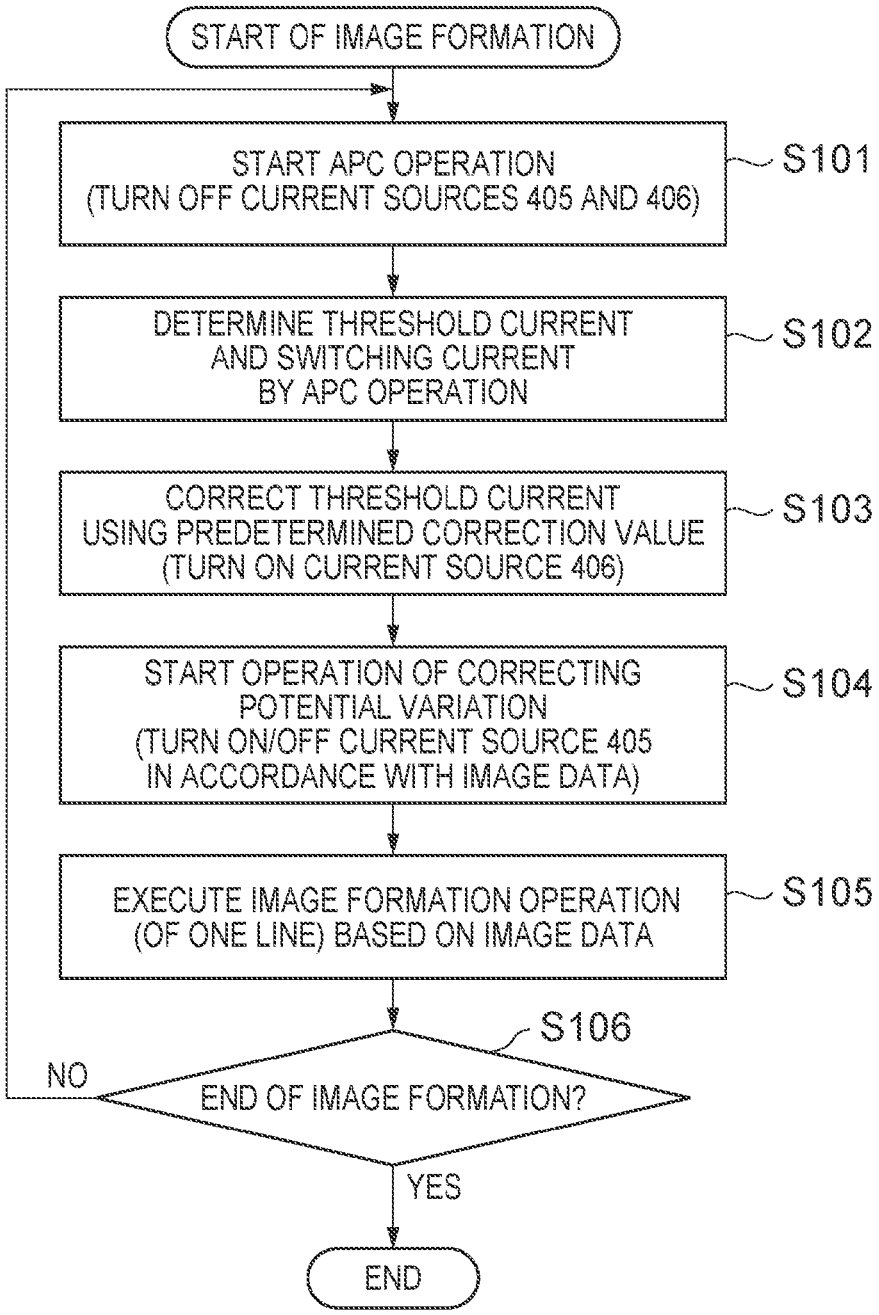
FIG. 7 is a flowchart showing the procedure of an image forming operation by the image forming apparatus 100 according to the first embodiment.

An image forming operation executed by the image forming apparatus 100 to reduce a variation in surface potential of the photosensitive member 11 due to unevenness of the sensitivity of the surface of the photosensitive member 11 in the main scanning direction will be described below with reference to FIGS. 4A and 4B. Note that FIG. 7 is a flowchart showing the procedure of an image forming operation by the image forming apparatus 100. The CPU (not shown) of the light power controller 47 executes a process in each step shown in FIG. 7 by reading out a control program stored in, for example, a memory in advance onto a RAM (not shown), and executing it. The image forming operation includes a correction operation based on the above-mentioned APC operation. Although only an operation for the laser LD1 will be mainly described for the sake of simplicity, the same as in the laser LD1 applies to the remaining lasers LD2 to LDn.

First, the CPU of the light power controller 47 (to be simply referred to as the "CPU" hereinafter) starts an image forming operation in response to, for example, input of an image forming command to start processes in steps S101 to S105. The CPU executes processes in steps S101 to S105 for each main scanning line on the surface of the photosensitive member 11. The CPU starts the above-mentioned APC operation in a non-image-forming area in step S101 before image formation (step S105) in an image region on each line. At this time, the CPU turns off the switches 408-1 and 410-1 to turn off the potential variation correction current source 405-1 and bias current correction current source 406-1, and executes an APC operation in this state. This APC operation is performed for the laser LD1 while bias currents for improving the light emission response characteristics of the lasers are supplied from the bias current sources 407-2 to 407-*n* to the lasers LD2 to LDn, respectively, as described above.

After the start of an APC operation, in step S102 the CPU determines a threshold current Ith3 and a switching current Isw1" as driving currents to be supplied to the laser LD1 by the APC operation. The threshold current Ith3 is corrected using a correction value ΔIth for correcting an error which occurs in the threshold current Ith3 upon APC in the multi-beam scheme, as described above. More specifically, before a shift to an image forming operation is made after an APC operation is completed, to supply a threshold correction current having the correction value ΔIth from the bias current correction current source 406-1 to the laser LD1, the light power controller 47 turns on the switch 408-1 to switch the bias current correction current source 406-1 from OFF to ON in step S103. Upon this operation, the threshold current Ith3 from the bias current source 407-1 is corrected to Ith3+ΔIth and starts to be supplied to the laser LD1.

In step S104, to reduce a variation in surface potential of the photosensitive member 11 due to unevenness of the sensitivity of the surface of the photosensitive member 11 in the main scanning direction, the CPU starts an operation of correcting the potential variation. More specifically, the CPU starts to control to turn on or off the switch 410-1 based on the input image data to turn on or off the state of current supply from the potential variation correction current source 405-1 to the laser LD1 based on the image data, as will be described later.

Note that in the BAE image forming apparatus 100, even when the surface of the photosensitive member 11 is charged to have a uniform potential, a potential variation may be generated as the potential varies depending on the position on this surface due to unevenness of the sensitivity of the photosensitive member 11. FIG. 4A shows a potential variation generated on the photosensitive member 11 in the main scanning direction. As can be seen from FIG. 4A, an error which varies depending on the position in the main scanning direction has occurred between a surface potential 421 of the photosensitive member 11 and an ideal potential 422. This occurs because the surface of the photosensitive member 11 has a sensitivity which varies depending on the position. To reduce such a potential variation, the image forming apparatus 100 controls to change the light power of the laser LD1 when the image modulation signal is Lo and no switching current is supplied to the laser LD1, in accordance with the correction value for each scanning position on the photosensitive member 11 in the main scanning direction.

In the laser driving device 31, if the image modulation signal (a pulse signal 431 in FIG. 4B) based on the input image data is Hi, the switch 409-1 is turned on, so a current is supplied from the switching current source 404-1 to the laser LD1. On the other hand, the pulse signal 431 input to the inverter 411 is sent to the switch 410-1 while its polarity is inverted from Hi to Lo. Hence, the switch 410-1 is turned off, so no current is supplied from the potential variation correction current source 405-1 to the laser LD1. In this manner, if the pulse signal 431 is Hi, the sum of a current Ith3 from the bias current source 407-1, a current ΔIth from the bias current correction current source 406-1, and a current Isw1"−ΔIth from the switching current source 404-1 is supplied to the laser LD1. That is, a driving current 432 having a magnitude Ith3+Isw1" is supplied to the laser LD1.

However, in the laser driving device 31, if the image modulation signal (pulse signal 431) based on the input image data is Lo, the switch 409-1 is turned off, so no current is supplied from the switching current source 404-1 to the laser LD1. On the other hand, the pulse signal 431 input to the inverter 411 is supplied to the switch 410-1 while its polarity is inverted from Lo to Hi, so a current is supplied from the potential variation correction current source 405-1 to the laser LD1. In this manner, if the pulse signal 431 is Lo, the sum of a current Ith3 from the bias current source 407-1, a current ΔIth from the bias current correction current source 406-1, and a current It from the potential variation correction current source 405-1 is supplied to the laser LD1 as a driving current 432.

The CPU of the light power controller 47 starts an operation of correcting a variation in surface potential of the photosensitive member 11 in step S104, and executes an image forming operation based on the image data in the image region in step S105. In forming an image in step S105, the CPU controls the laser driving device 31 so as to supply a correction current It for correcting a potential variation from the potential variation correction current source 405-1 to the laser LD1. More specifically, the CPU of the light power controller 47 controls so that a correction current It having a magnitude corresponding to the correction value determined for each scanning position in the main scanning direction in advance is supplied from the potential variation correction current source 405-1 to the laser LD1 in synchronism with a BD signal. Note that the BD signal is output from the BD sensor 36, and corresponds to a main scanning synchronization signal. The correction current It changes across individual scanning positions (main scanning positions) on the photosensitive member 11 in the main scanning direction around the threshold current Ith_real, as shown in FIG. 4B.

The CPU of the light power controller 47 stores in an internal memory a correction value corresponding to the scanning position on the photosensitive member 11 in the main scanning direction, and reads out and uses the correction value in synchronism with the BD signal. The light power controller 47 changes the magnitude of the correction current It supplied from the potential variation correction current source 405-1 to the laser LD1 in accordance with the correction value read out from the memory, using a control signal output to the potential variation correction current source 405-1. That is, the correction current It changes depending on the measurement value of the surface potential of the photosensitive member 11.

This correction value is generated from, for example, a measurement value obtained by measuring the sensitivity of the surface of the photosensitive member 11 at each main scanning position during factory adjustment, and is stored in the internal memory of the light power controller 47. The sensitivity of the photosensitive member 11 is obtained as the measurement value of the surface potential of the photosensitive member 11 when, for example, the surface of the photosensitive member 11 charged by the primary charger 28 is irradiated with a laser beam having a light power which stays constant irrespective of the main scanning position. The correction value may correspond to the correction current It supplied from the potential variation correction current source 405-1 to the laser LD1 to make the laser LD1 emit a laser beam at a light power at which the change in measured surface potential in the main scanning direction stays constant.

If the image modulation signal is Lo, the light power of a laser beam applied from the laser LD1 to the photosensitive member 11 changes across individual main scanning positions on the photosensitive member 11 in accordance with the above-mentioned correction value, so the surface potential of the photosensitive member 11 after irradiation with the laser beam becomes uniform irrespective of the main scanning position.

After an image forming operation of one line is completed, the CPU determines in step S106 whether a series of image forming operations is to end, based on whether the next line to undergo an image forming operation remains for the input image data. If NO is determined in step S106, the CPU returns the process to step S101; otherwise, it ends a series of image forming operations shown in FIG. 7.

As described above, in this embodiment, APC for controlling the light power of a laser beam emitted by each of a plurality of laser light sources (LD1 to LDn) to a target light power is performed to determine a threshold current and switching current to be supplied to each of the plurality of laser light sources. Also, for each of the plurality of laser light sources, the determined threshold current is corrected using a predetermined correction value representing the difference between a threshold current obtained from the light emitting characteristics of a single laser light source when only the single laser light source emits a laser beam, and a threshold current obtained from the light emitting characteristics of the plurality of laser light sources when the plurality of laser light sources emit laser beams without laser oscillation of the laser light sources other than the single laser light source. The thus obtained, corrected threshold current and switching current are supplied to each of the plurality of laser light sources to irradiate the photosensitive member 11 with a plurality of laser beams and scan the surface of the photosensitive member 11 with the plurality of laser beams.

According to this embodiment, even if the threshold current determined by APC becomes lower than an original current value due to factors associated with the use of the multibeam scheme, it can be corrected to the original current value. As a result, by supplying a current corresponding to the measurement value of the sensitivity of the photosensitive member 11 to each laser light source, a potential variation on the surface of the photosensitive member 11 can be reduced even when the multibeam scheme is adopted.

Although a mode in which the present invention is applied to a BAE image forming apparatus has been described in this embodiment, the present invention is not limited to a BAE image forming apparatus, and is similarly applicable to an image exposure image forming apparatus. When the present invention is applied to an image forming apparatus adopting an image exposure scheme as well, each laser light source can be driven in accordance with an appropriately corrected threshold current. When the image forming apparatus forms an image, it can obtain an image with higher quality because the leading edge of light from each laser light source becomes sharper.

Second Embodiment

In the first embodiment, to correct a threshold current for a multibeam laser, a correction current corresponding to the difference value between an original threshold current Ith_real and a threshold current Ith3 obtained by APC is supplied to each laser, together with the threshold current Ith3. Also, during factory adjustment, a threshold current Ith_real and a threshold current Ith3 are measured, and their difference value is sent to the bias current correction current sources 406-2 to **406-*n*** as a fixed value.

Note that the light emitting characteristics of each laser in a multibeam laser may change depending on the temperature, and the threshold current also changes in that case. A laser such as an infrared laser is known to have light emitting characteristics which change little depending on the temperature, while a laser such as a red laser is known to have light emitting characteristics which considerably change depending on the temperature, and a threshold current which changes depending on the temperature as well.

Figure 5A:
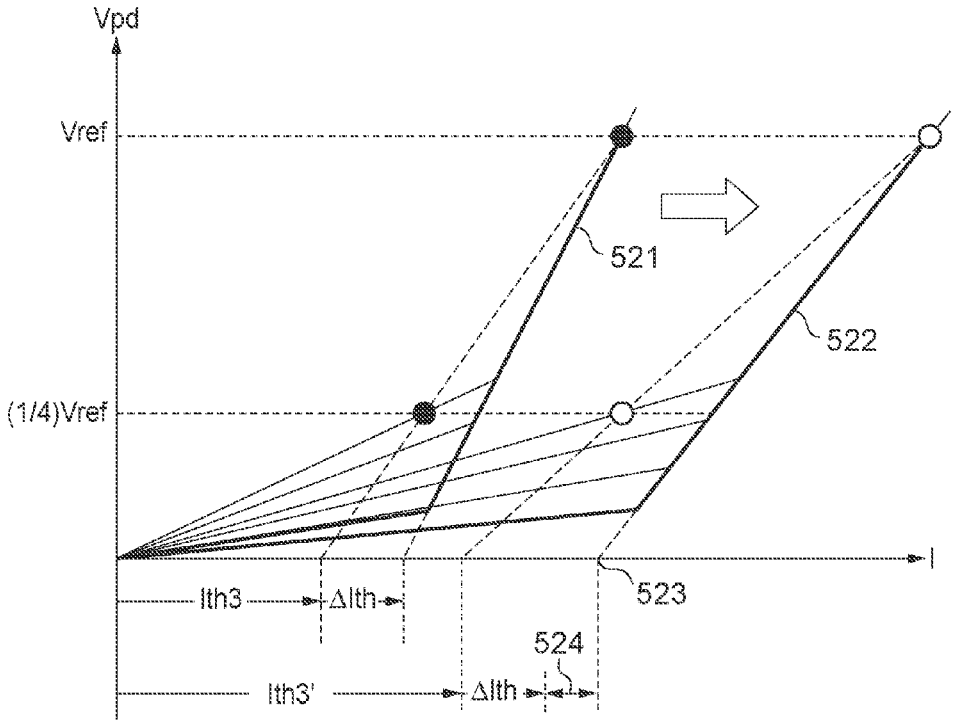
FIG. 5A is a graph showing how the light emitting characteristics of a multibeam laser change with a rise in temperature.

FIG. 5A is a graph showing how the light emitting characteristics of each laser in a multibeam laser change with a rise in temperature. Referring to FIG. 5A, light emitting characteristics 521 of each laser before a rise in temperature are the same as those (FIGS. 3D and 4B) shown in the first embodiment. Therefore, a threshold current obtained by APC for the light emitting characteristics 521, and a correction current for correcting the threshold current are the threshold current Ith3 and current ΔIth, respectively, as in the first embodiment. Referring to FIG. 5A, as the temperature of each laser rises, the light emitting characteristics 521 change to light emitting characteristics 522, and the threshold current rises. That is, the threshold current Ith3 obtained by APC changes to a threshold current Ith3'. In this case, if the correction current is fixed at ΔIth for the threshold current Ith3', the current falls an amount 524 short of an original threshold current 523 in the changed light emitting characteristics 522.

In this manner, if the threshold current changes due to a change in temperature, setting a fixed value as the correction current for correcting the threshold current, as in the first embodiment, may make it impossible to appropriately correct the threshold current changed depending on the temperature. When this happens, the threshold current supplied to each laser may deviate from an original threshold current, thus making it impossible to reduce a variation in surface potential of the photosensitive member 11.

In the second embodiment, instead of fixing the correction current for the threshold current, the temperature of each laser is detected and the correction current is changed in response to a change in detected temperature, unlike the first embodiment. Note that the same parts as in the first embodiment will not be described hereinafter as much as possible for the sake of simplicity.

Figure 5B:
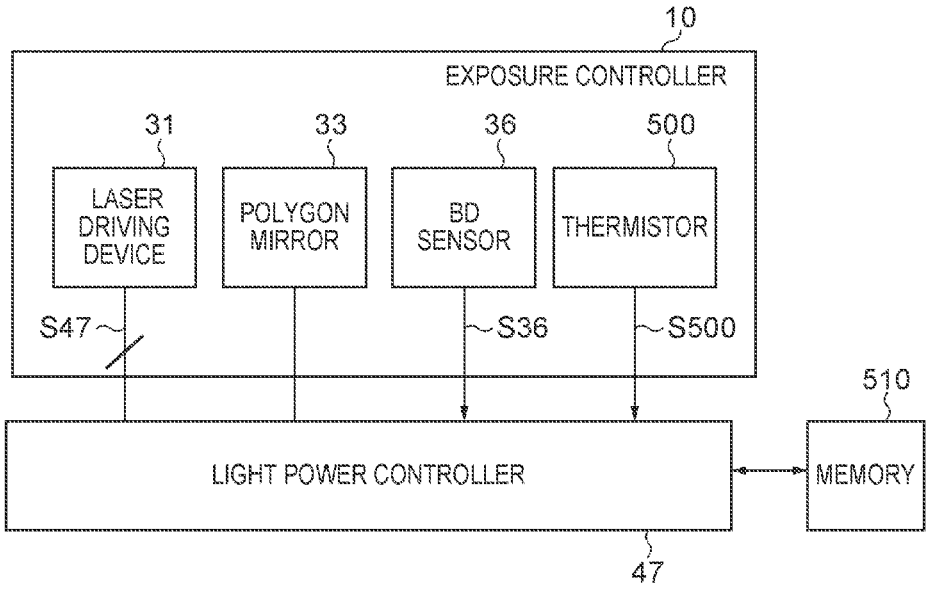
FIG. 5B is a block diagram showing the connection relationship between an exposure controller 10 and a light power controller 47 according to the second embodiment.

FIG. 5B is a block diagram showing the connection relationship between an exposure controller 10 and a light power controller 47 according to this embodiment. Referring to FIG. 5B, a thermistor 500 in the exposure controller 10, and a memory 510 connected to the light power controller 47 are added to the arrangement shown in FIG. 2B of the first embodiment. When the thermistor 500 placed near a laser driving device 31 in the exposure controller 10 detects the temperature in the vicinity of a laser, it transmits a detect signal 5500 indicating the detected temperature to the light power controller 47. The light power controller 47 adjusts currents supplied from bias current correction current sources 406-1 to **406-*n* to lasers LD1 to LDn, respectively, based on the temperature detected by the thermistor 500. In this manner, the thermistor 500** is an example of a temperature detection unit.

Note that the bias current correction current sources 406-1 to **406-*n* can be adjusted based on the electronic volume, as in the first embodiment. The memory 510 stores a correction current value corresponding to ΔIth measured at a predetermined temperature (20° C. in FIG. 5C) for each laser during factory adjustment. The light power controller 47 sets, in each of the bias current correction current sources 406-1 to 406-*n*, a current value obtained by multiplying the correction current value stored in the memory 510 by a coefficient α determined in accordance with the temperature detected by the thermistor 500. In this way, the correction current value is adjusted for each of the bias current correction current sources 406-1 to 406-*n* in accordance with the detected temperature of the corresponding one of a plurality of laser light sources (LD1 to LDn) so as to compensate for a change in ΔIth due to a change in temperature of this laser light source. The coefficient α may be stored in the memory 510 as, for example, a table which associates the coefficient α with the temperature of each laser light source. In this case, a value obtained by multiplying the correction current value which is stored in the memory 510 and corresponds to 20° C. by the coefficient α corresponding to the temperature detected by the thermistor 500, which is included in the table stored in the memory 510**, may be set as an adjusted correction current value.

Figure 5C:
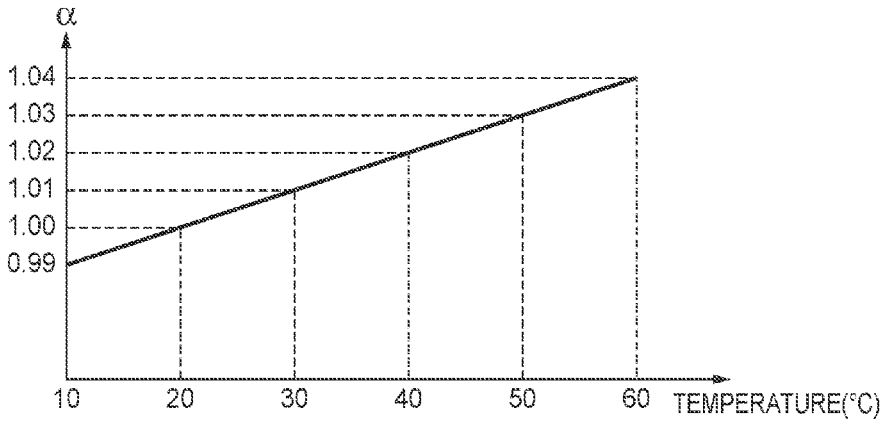
FIG. 5C is a graph showing the relationship between the temperature of a multibeam laser and a coefficient $\alpha$ for adjusting a correction value for a threshold current.

The laser temperature characteristics representing the relationship between the laser temperature and the laser threshold current can be approximated by a linear function. FIG. 5C shows the relationship between the temperature detected by the thermistor 500 and the coefficient α used in correspondence with the detected temperature, which is determined based on the laser temperature characteristics. In this embodiment, the light power controller 47 determines the coefficient α as a function of the detected temperature, from the temperature detected by the thermistor 500 and the characteristics shown in FIG. 5C. The light power controller 47 multiplies a threshold current value stored in the memory 510 in advance by the determined coefficient α to calculate a new threshold current value. The memory 510 stores, in advance, a threshold current value which is obtained during factory adjustment and corresponds to α=1.

Referring to FIG. 5C, α is defined as 1 at a temperature of 20° C. The light power controller 47 multiplies the correction current value which is stored in the memory 510 and corresponds to 20° C. by the coefficient α corresponding to the temperature detected by the thermistor 500, thereby determining a correction current value to be set in each of the bias current correction current sources 406-1 to **406-*n*. Also, the light power controller 47 sets the determined threshold current value in each of the bias current correction current sources 406-1 to 406-*n*. Upon this operation, the bias current correction current sources 406-1 to 406-*n* supply threshold currents having the set values to the lasers LD1** to LDn, respectively.

According to this embodiment, even if the light emitting characteristics of a plurality of lasers change due to changes in temperature of the plurality of lasers, it is possible not only to appropriately correct the threshold current determined by APC but also to reduce a variation in surface potential of the photosensitive member 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2011-191068, filed Sep. 1, 2011, which is hereby incorporated by reference herein in its entirety.

What is claimed is:

1. An exposure apparatus which includes a plurality of laser light sources, and exposes a surface of a photosensitive member with a plurality of laser beams output from the plurality of laser light sources in accordance with driving currents, the exposure apparatus comprising:

a detection unit constructed to detect a laser beam output from each of the plurality of laser light sources; and a control unit constructed to supply a switching current to a single laser light source while bias currents are supplied to the plurality of laser light sources, and to control a value of a current supplied to the single laser light source so that a light power of a laser beam which is output from the single laser light source and is detected by the detection unit becomes a first light power or a second light power, wherein the control unit comprises:

a determination unit constructed to determine a value of a threshold current of the single laser light source, based on a relationship between the first light power and a first value of the current supplied to the single laser light source for causing the detection unit to detect the laser beam of the first light power, and based on a relationship between the second light power and a second value of the current supplied to the single laser light source for causing the detection unit to detect the laser beam of the second light power;

a correction unit constructed to add, to the value of the threshold current, a correction amount obtained based on a light power of a laser light source which is other than the single laser light source and which emits a laser beam by a bias current being supplied; and a current supply unit constructed to supply, to the single laser light source, a bias current which is based on a value obtained by adding the correction amount to the value of the threshold current, wherein the current supply unit comprises:

a first current source which is connected to the single laser light source, and which is constructed to supply the bias current determined by the determination unit to the single laser light source;

a second current source which is connected to the single laser light source in parallel with the first current source, and which is constructed to supply the switching current to the single laser light source;

a switch which is connected to the single laser light source in parallel with the first current source between the single laser light source and the second current source, the switch switching a state of supply of a current from the second current source to the single laser light source between a supplied state and an unsupplied state; and a third current source which is connected between the second current source and the single laser light source, and which is constructed to bypass a partial current, corresponding to the correction value, of the current output from the second current source to the single laser light source without mediacy of the switch.

2. The exposure apparatus according to claim 1, wherein the correction unit further corrects the switching current by decreasing the switching current by an amount corresponding to a predetermined correction value, and the current supply unit supplies a drive current corresponding to the bias current and the switching current corrected by the correction unit to the single laser light source.

3. The exposure apparatus according to claim 1, wherein the determination unit performs light power control of the single laser light source without an operation of the third current source to determine the threshold current, and the correction unit operates the third current source to add the correction amount to the value of the threshold current.

* * * * *